US007911143B2

(12) United States Patent
Koger et al.

(10) Patent No.: US 7,911,143 B2
(45) Date of Patent: Mar. 22, 2011

(54) DISCHARGE LAMP WITH A HOLDING APPARATUS FOR THE ELECTRODES

(75) Inventors: Rainer Koger, Berlin (DE); Lars Menzel, Berlin (DE); Matthias Morkel, Berlin (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 218 days.

(21) Appl. No.: 12/227,416

(22) PCT Filed: Jun. 4, 2007

(86) PCT No.: PCT/EP2007/055471

§ 371 (c)(1),
(2), (4) Date: Nov. 17, 2008

(87) PCT Pub. No.: WO2007/141243

PCT Pub. Date: Dec. 13, 2007

(65) Prior Publication Data

US 2009/0167181 A1 Jul. 2, 2009

(30) Foreign Application Priority Data

Jun. 9, 2006 (DE) ..... 10 2006 026 940

(51) Int. Cl.
*H01J 61/04* (2006.01)
*H01J 19/42* (2006.01)
*H01J 1/88* (2006.01)

(52) U.S. Cl. ..... 313/623; 313/625; 313/335; 313/331

(58) Field of Classification Search ..... 313/623–625, 313/238–292

See application file for complete search history.

(56) References Cited

U.S. PATENT DOCUMENTS

| | | | |
|---|---|---|---|
| 2,087,735 | A | 10/1936 | Pirani et al. |
| 2,725,498 | A | 6/1952 | Storms et al. |
| 3,154,713 | A | 10/1964 | Beese |
| 5,608,227 | A | 3/1997 | Dierks et al. |

FOREIGN PATENT DOCUMENTS

| | | | |
|---|---|---|---|
| DE | 30 29 824 | A1 | 8/1980 |
| DE | 30 29 824 | C2 | 8/1980 |
| DE | 102 09 424 | A1 | 3/2002 |
| DE | 102 09 426 | A1 | 3/2002 |
| EP | 0 479 088 | A1 | 9/1991 |
| JP | 2000-149872 | A | 5/2000 |

OTHER PUBLICATIONS

English-translation of Notification for the Opinion of Examination dated Oct. 21, 2010, in Taiwanese Patent Application No. 96119937 including Search Report (5 pages).

*Primary Examiner* — Mariceli Santiago

(74) *Attorney, Agent, or Firm* — Holtz, Holtz, Goodman & Chick, P.C.

(57) ABSTRACT

The invention relates to a discharge lamp, in particular a high-pressure discharge lamp, having a discharge vessel (1) which has two diametrically opposite necks (2, 3) into each of which a holding rod (5, 10) is fused at least in places, with an electrode (4, 9) which extends into the discharge vessel (1) being arranged on each holding rod (5, 10), and with in each case at least one annular plate (7, 12) at least partially clasping a holding rod (5, 10), with at least one of the annular plates (7, 12) being arranged in the discharge vessel (1).

12 Claims, 2 Drawing Sheets

DISCHARGE LAMP WITH A HOLDING APPARATUS FOR THE ELECTRODES

This application is a U.S. National Phase Application under 35 USC 371 of International Application PCT/EP2007/055471, filed Jun. 4, 2007, which is incorporated herein in its entirety by this reference.

TECHNICAL FIELD

The invention relates to a discharge lamp, in particular a high-pressure discharge lamp, with a discharge vessel, which has two diametrically opposite necks, into which in each case one holding rod is fused, at least in regions, and an electrode extending into the discharge vessel is arranged on each holding rod. In each case at least one annular plate is arranged on each holding rod so as to engage at least partially around it.

PRIOR ART

High-pressure discharge lamps, for example mercury-vapor lamps (HBO lamps), owing to their size and construction, are sensitive to shock loads, as may occur in the case of relatively severe, short-term force effects. In particular during transport, such lamps can be subjected to such shock loads. In particular in the case of lamps with powers of greater than 2 kW, there is a not inconsiderable risk of breakage of the lamp if such force effects take place owing to the size of the electrode. Resultant damage can lead to unusability of the lamp. Not least this results in an unavoidable amount of rejects of lamps and furthermore also decreases customer satisfaction.

In the case of some lamp types, even in the event of relatively low force effects, as may occur, for example, in the event of an impact on a floor from a relatively low height, breakages have been observed. As a result of relatively complex design changes to the lamp, an increase in the resistance to breakage can in this case be achieved. Nevertheless, this is also limited and lamp breakages still occur in the event of such short-term force effects.

During operation of the lamp, high pressures of several tens of bar occur, for example, in the case of HBO lamps after vaporization of the discharge carrier, mercury. The construction of the lamp needs to withstand these pressures.

FIG. 1 shows a sectional illustration of a subregion of a known high-pressure discharge lamp. The lamp I comprises a discharge vessel 1, which is in the form of a quartz glass bulb and on which two necks 2 and 3 are arranged diametrically opposite one another. An anode 4, which is fastened on a holding rod 5, is arranged in the discharge vessel 1. The holding rod 5 extends into the bulb neck 2, with it being arranged, at least in regions, in a holding part, which comprises a conical supporting roller 6, an annular plate 7 adjoining said supporting roller and a quartz block 8 adjoining said annular plate. The components 6, 7 and 8 have central bores, into which the holding rod 5 is inserted. The supporting roller 6 is likewise formed from quartz glass. Said components 5 to 8 are fused into the bulb neck 2.

Furthermore, the high-pressure discharge lamp I comprises a cathode 9, which is likewise arranged in the discharge vessel 1 and is fastened on a holding rod 10. This holding rod 10 also extends into the bulb neck 3 and is in this case arranged in a central bore of a supporting roller 11, which is formed from quartz glass. In turn, this supporting roller 11 is adjoined by an annular plate 12, into which the holding rod 10 likewise extends. In turn, a quartz block 13 adjoins the holding rod 10 and the plate 12. The plates 7 and 12 are soldered onto the holding rods 5 and 10, respectively, and are designed to anchor the holding rods 5 and 10 in the lamp shaft and, respectively, the bulb necks 2 and 3. The plates 7 and 12 are in this case firmly embedded in the quartz material of the lamp shafts, as a result of which torques occurring in the event of shock loads are absorbed. The holding rods are relatively long and in particular the spacing between a plate and the electrode is relatively large, as a result of which relatively large leverage forces occur in the event of a force effect.

Similar configurations of high-pressure lamps are known from DE 102 09 426 A1 and DE 102 09 424 A1.

One disadvantage of the existing, rigid construction in which the plates 7 and 12 are anchored in the bulb necks 2 and 3 can be considered to be the fact that torques occurring in the event of a shock load on the holding rods 5 and 10 and the plates 7 and 12 are transmitted substantially undamped to the glass of the discharge vessel 1 and thus result in a high degree of stress on the glass. The risk of breakage or at least the occurrence of cracks which impair operation is thus relatively high.

DESCRIPTION OF THE INVENTION

The object of the present invention is therefore to provide a discharge lamp which has such a construction that damage in the event of short-term force effects can at least be reduced.

This object is achieved by a discharge lamp having the features as claimed in patent Claim 1.

A discharge lamp according to the invention, in particular a high-pressure discharge lamp, comprises a discharge vessel, which has two preferably diametrically opposite necks, into which in each case one holding rod is fused, at least in regions, and an electrode extending into the discharge vessel is arranged on each holding rod. In each case at least one annular plate is arranged at least on one, preferably on both, of the holding rods so as to at least partially engage around it. At least one of these annular plates is positioned in the discharge vessel. This structural configuration can provide a discharge lamp in which even relatively severe shock loads, as may occur, for example, during transport, can be absorbed without the lamp being damaged or destroyed. In particular, the arrangement of the annular plate in the discharge vessel can result in a structural configuration which, in the event of a force effect, provides degrees of freedom to the extent that the arrangement can at least vibrate such that no flaws or crack formations occur in the discharge vessel. Torques as may occur in the case of such shock loads are therefore no longer transmitted substantially undamped to the necks and in particular to the discharge vessel. Tests have shown that the discharge lamp survives short-term shock loads with free-fall acceleration of 80 g undamaged.

The plate is preferably arranged such that significantly shorter holding rods can be used in comparison with the prior art. In particular, the spacing between the plate and that end of an electrode which faces the holding rod is significantly shorter than, for example, for the configuration of a lamp shown in FIG. 1. As a result, the leverage forces can be substantially reduced in the event of a force effect. It can be provided that this spacing is approximately 25%, in particular 50%, in particular 75% shorter in comparison with the prior art shown in particular in FIG. 1.

Preferably, this at least one annular plate, which is arranged in the discharge vessel, is fixed at least in the axial direction of the holding rod by a support body. Preferably, the plate is arranged, at least in regions, in the support body, the support body advantageously completely surrounding the plate.

As a result of the modified construction, at least one of the annular plates can be arranged so as to be drawn into the discharge vessel without the position of the electrode which is arranged on the associated holding rod needing to be changed. The position of this electrode is still precisely defined. However, in the event of shock loads, this annular plate can vibrate at least such that the forces are no longer transmitted undamped and completely to the discharge vessel and/or the necks.

The plate is advantageously fused into the support body. The support body also therefore extends into the interior of the discharge vessel, at least in regions. As a result, on the one hand a mechanically stable construction can be provided which, on the other hand, allows for a sufficient degree of freedom for the vibration of the plate.

Preferably, the support body is tubular and is designed to accommodate further components of the discharge lamp. In terms of design, the support body is preferably configured such that it surrounds, in addition to the annular plate, a quartz block, with at least one molybdenum foil being attached to the outside of said quartz block. The quartz block can in this case also be arranged such that it extends partially into the discharge vessel. Advantageously, the holding rod also extends into this quartz block. In a structurally preferred embodiment, the annular plate, which is arranged in the discharge vessel, rests against a front end of the quartz block, and the holding rod extends through a central opening in this plate and a central bore in the quartz block. As a result of this arrangement, the entire fastening process of the individual components with respect to one another can be improved further and the overall stability of the lamp can be increased.

The support body is preferably arranged so as to rest against an inside of the neck, in which the holding rod of the associated electrode preferably also extends. The support body and preferably also the quartz block are advantageously fused into the corresponding neck in sealing fashion in such a way that they are spaced apart from the plate on that side of the plate which is remote from the discharge vessel. In order to fix the plate in particular in the axial direction of the discharge lamp, which corresponds to the axial direction of the holding rod, the electrode system is therefore preferably fused twice. In this case, the support body advantageously surrounds the entire foil system which is fitted on the outside of the quartz block and the annular plate in the discharge vessel. The actual shaft tube or the actual neck is preferably only fused on to a region behind the plate and therefore in a region which is on that side of the plate which is remote from the electrode.

As a result of the fact that the holding rod extends as far as into the quartz block, rotations perpendicular to the lamp axis and therefore also rotational movements about the axis of the holding rod can also be avoided.

The support body is preferably designed to be rounded off at an end facing the electrode. Preferably, each body has, on this rounded-off front side, a central bore, through which the holding rod extends. The support body is advantageously arranged such that it engages around the holding rod between the annular plate, which is arranged in the discharge vessel, and the electrode which is arranged freely in the discharge vessel. Preferably, the plate is positioned directly at this front rounded-off end of the support body, with the result that, owing to this tapered configuration of the front end of this support body, the annular plate is thereby held in the axial direction and is held on the opposite side by the preferably directly adjacent quartz block.

In an advantageous configuration, the support body is formed from glass or a material similar to glass. Preferably, this support body is designed from such a material which allows for further processing with a view to introducing, in particular fusing, the components into the neck of the discharge vessel.

In a particularly advantageous configuration, at least the annular plate, in particular exclusively the annular plate which surrounds that holding rod on which the anode is attached, is positioned in the discharge vessel. Since it is precisely the anode, in terms of its shape and its weight, which is primarily responsible for the damage to the lamp occurring in the event of a shock load and therefore damage occurs in particular in that neck in which the holding rod of the anode is fused, which damage may extend to the discharge vessel, it is particularly advantageous if precisely this plate which is associated with the anode is positioned so as to be drawn conceptually into the discharge vessel. It can also be provided that, instead or in addition, an annular plate of the cathode is arranged in the discharge vessel.

In an advantageous embodiment, the discharge lamp is in the form of a mercury-vapor lamp (HBO lamp).

As a result of the proposed discharge lamp, the resistance to bursting pressure can also be increased in addition to the resistance to breakage.

In particular the fused-seal design allows for the increased resistance to bursting pressure.

BRIEF DESCRIPTION OF THE DRAWINGS

An exemplary embodiment of the invention will be explained in more detail below with reference to a schematic drawing, in which.

PREFERRED EMBODIMENT OF THE INVENTION

Identical or functionally identical elements are provided with the same reference symbols in the figures.

Figure 2:
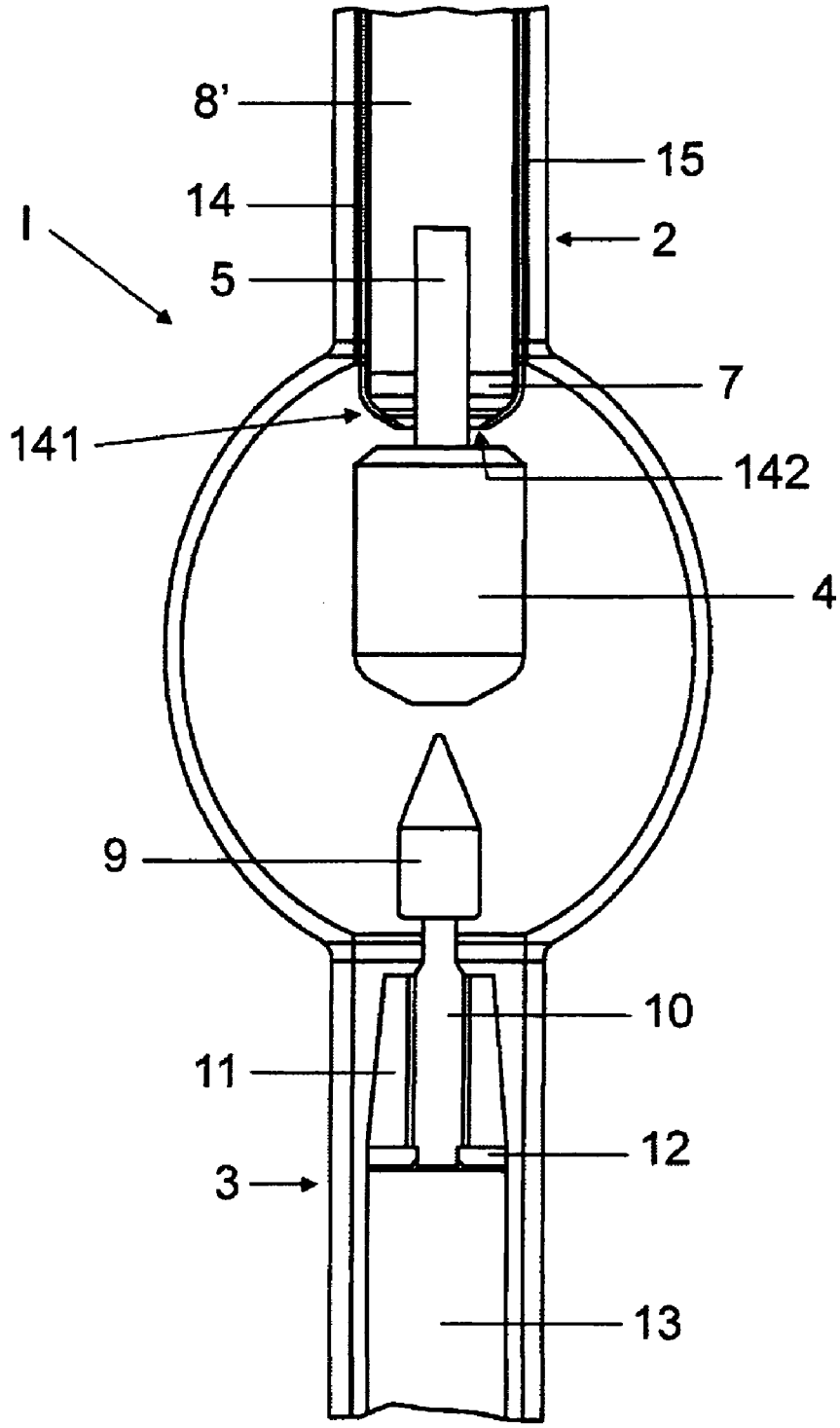
FIG. 2 shows a sectional illustration of a subregion of a discharge lamp according to the invention.

The schematic sectional illustration in FIG. 2 shows the components of a discharge lamp in the form of a mercury-vapor lamp I which are essential for the understanding of the invention. The mercury-vapor lamp I comprises a discharge vessel 1 made from quartz glass which is shaped so as to be elliptical. Adjacent to this on two opposite sides are two ends which are in the form of necks 2 and 3. In the exemplary embodiment, the necks 2 and 3 are formed to have a substantially constant diameter over their length. However, it can also be provided that the necks vary in terms of their diameter over their length and in particular are formed so as to be tapered, in particular conically, in particular in the region in which they merge with the discharge vessel 1.

Figure 1:
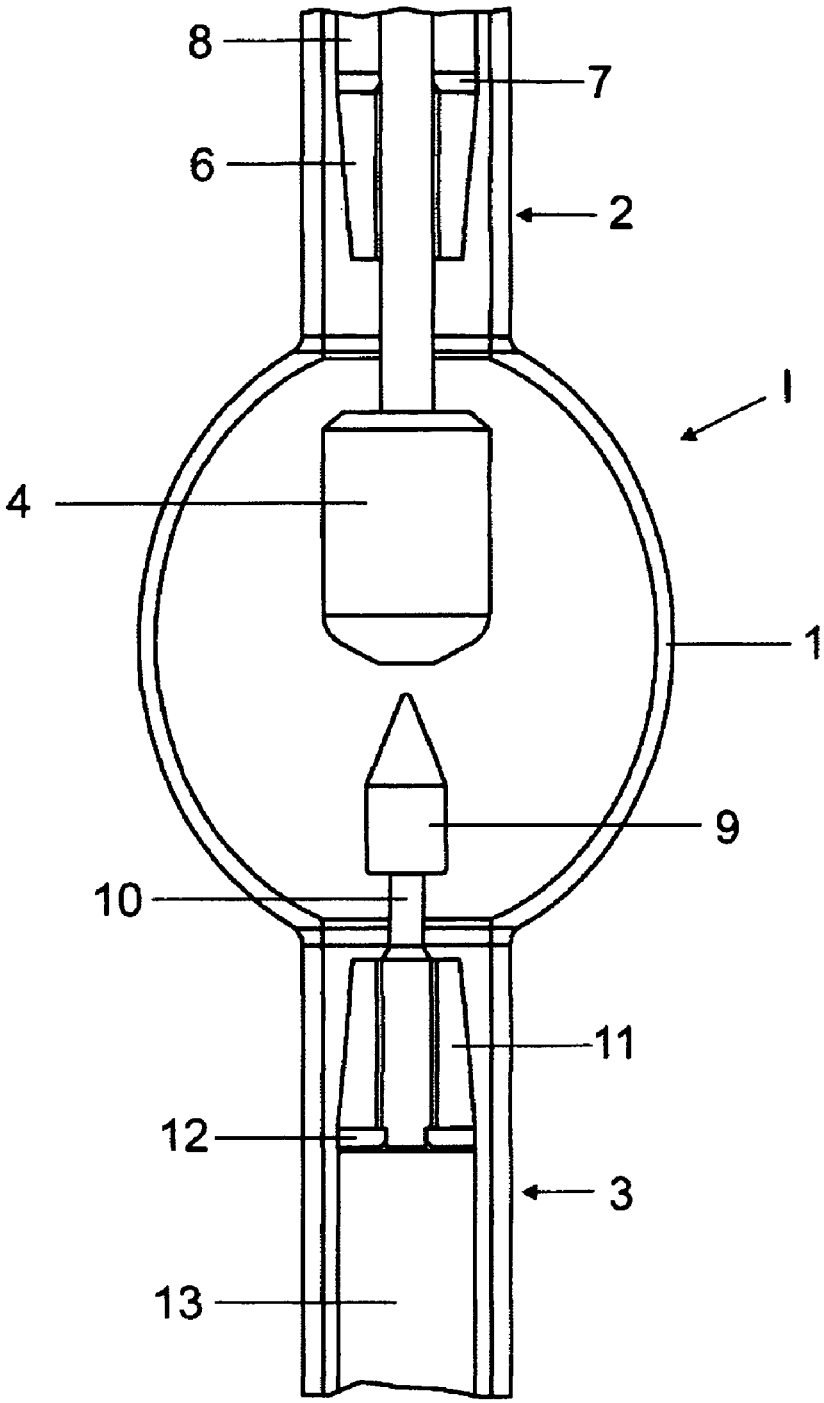
FIG 1 (Prior art)
FIG. 1 shows a sectional illustration of a high-pressure discharge lamp known from the prior art.

In the exemplary embodiment, the arrangement known from FIG. 1 in the neck 3 is shown, in which case a similar configuration to the known discharge lamp shown in FIG. 1 in this region is provided. For this purpose, a cathode 9 is positioned in the discharge vessel 1 and is fastened on a holding rod 10, which extends into a supporting roller 11, the supporting roller 11 having a central bore for this purpose. An annular plate 12, which likewise has a central bore into which the holding rod extends, is provided adjacent to the supporting roller 11. A quartz block 13 is provided adjacent to the annular plate 12, these components being fused into the neck 3 in sealing fashion. In the region of the cathode 9 and therefore in the region of the neck 3, only the holding rod 10 extends partially into the discharge space and therefore into the discharge vessel 1.

In the exemplary embodiment, the anode 4 is likewise arranged within the discharge vessel 1 on the opposite side. This anode 4 is fastened on a holding rod 5, which extends into a quartz block 8'. For this purpose, the quartz block 8' has a central bore on its side facing the anode 4. As can be seen in FIG. 2, the holding rod 5 is surrounded by an annular plate 7, which is located within the discharge vessel 1. The annular plate 7 is in this case arranged on the front side of the quartz block 8' and has an opening, through which the holding rod 5 extends. As can be seen from the illustration in FIG. 2, the quartz block 8' is arranged such that it also extends partially into the discharge vessel 1.

Molybdenum foils 15 are attached, in particular fused on, on an outer side of the quartz block 8'. These molybdenum foils 15 are guided along over the entire length of the cylindrical quartz block 8' and are provided for electrical contact-making purposes.

The annular plate 7 and the quartz block 8' and the foils 15 resting against said quartz block are fused in a tubular support body 14, which is formed from quartz glass in the exemplary embodiment. As can be seen here, the support body 14 is formed so as to be tapered at its front end facing the anode 4 and has rounded-off regions 141. The support body 14 likewise extends partially into the discharge vessel and also at least partially surrounds the holding rod 5, with this holding rod 5 extending through an opening 142 in the support body 14. As can be seen, the annular plate 7 is arranged in the front region of this support body 14 and is positioned so as to be directly adjacent to the rounded-off regions 141. The annular plate 7 is therefore fixed in the axial direction and thus in the direction of the longitudinal axis of the holding rod 5 by means of the support body 14 and the directly adjacent quartz block 8'. As can be seen, the support body 14 is arranged in such a way that it engages around the holding rod 5 between the annular plate 7 and the anode 4.

For the further fixing and positionally accurate arrangement of this support body 14 and the mentioned components which are fastened and arranged therein, the neck 2 is fused on merely on a side of the annular plate 7 which is remote from the anode 4. The electrode system of the anode 4 is therefore fused in twice in particular in order to fix the annular plate 7. The support body 14 thus rests with its outer side directly against an inner side of the neck 2, at least in regions.

Owing to this arrangement of the annular plate 7, firstly mechanically precise positioning thereof is ensured, but secondly it is also possible for at least this annular plate 7 to be free in the event of shock loads on the mercury-vapor lamp I, at least such that a vibration is possible and therefore the forces which are acting can be damped and virtually dissipated without them being transmitted substantially completely to the neck 2 and the discharge vessel 1. As a result of this construction, the resistance to breakage can be significantly increased, and it can be expected that the pressure resistance of the discharge vessel and therefore the operational reliability also increase.

The invention claimed is:

1. A discharge lamp, with a discharge vessel (1), which has two diametrically opposite necks (2, 3), into which in each case one holding rod (5, 10) is fused, at least in regions, and an electrode (4, 9) extending into the discharge vessel (1) is arranged on each holding rod (5, 10), and in each case at least one annular plate (7, 12) engages at least partially around a holding rod (5, 10),
characterized in that
at least one of the annular plates (7, 12) is arranged in the discharge vessel (1)
characterized in that
the plate (7, 12) which is arranged in the discharge vessel (1) is arranged in a support body (14);
the support body (14) is designed to be rounded off at an end (141) facing the electrode (4, 10), and
the holding rod (5, 10) is guided through an opening (142) in the support body (14).

2. The discharge lamp as claimed in claim 1,
characterized in that
the plate (7, 12) is fused into the support body (14).

3. The discharge lamp as claimed in claim 1,
characterized in that
the support body (14) is tubular and extends into the discharge vessel (1).

4. The discharge lamp as claimed in claim 1,
characterized in that
the support body (14) surrounds the annular plate (7, 12) and a quartz block (8'), with molybdenum foils (15) being attached to the outside thereof.

5. The discharge lamp as claimed in claim 4,
characterized in that
the holding rod (5) extends into the quartz block (8').

6. The discharge lamp as claimed in claim 4 or 5,
characterized in that
the plate (7, 12) which is arranged in the discharge vessel (1) rests against the quartz block (8').

7. The discharge lamp as claimed in claim 1,
characterized in that
the support body (14) rests against the inside of a neck (2, 3).

8. The discharge lamp as claimed in claim 1,
characterized in that
at least the support body (14) is fused into the neck (2, 3) in sealing fashion on that side of the plate (7, 12) which is remote from the discharge vessel (1).

9. The discharge lamp as claimed in claim 1,
characterized in that
the support body (14) is formed from glass.

10. The discharge lamp as claimed in claim 1,
characterized in that
that annular plate (7, 12) which surrounds the holding rod (5, 10) on which an anode (4) is attached is positioned in the discharge vessel (1).

11. The discharge lamp as claimed in claim 1, which is in the form of a mercury-vapor lamp.

12. The discharge lamp as claimed in claim 1 which is a high pressure discharge lamp.

* * * * *